US012048404B2

(12) United States Patent
Smith et al.

(10) Patent No.: US 12,048,404 B2
(45) Date of Patent: Jul. 30, 2024

(54) FLOOR CLEANING SYSTEM, FLAT HEADED MOP AND MOP PAD

(71) Applicant: Unger Marketing International, LLC, Bridgeport, CT (US)

(72) Inventors: Robert F. Smith, Waterbury, CT (US); Joseph K. Patterson, Monroe, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 0 days.

(21) Appl. No.: 17/113,581

(22) Filed: Dec. 7, 2020

(65) Prior Publication Data

US 2021/0177229 A1 Jun. 17, 2021

Related U.S. Application Data

(60) Provisional application No. 62/946,614, filed on Dec. 11, 2019.

(51) Int. Cl.

| | |
|---|---|
| ***A47L 13/16*** | (2006.01) |
| ***A47L 13/256*** | (2006.01) |
| ***A47L 13/257*** | (2006.01) |
| ***A47L 13/44*** | (2006.01) |
| ***A47L 13/58*** | (2006.01) |

(52) U.S. Cl.

CPC ..... *A47L 13/16* (2013.01); *A47L 13/256* (2013.01); *A47L 13/257* (2013.01); *A47L 13/44* (2013.01); *A47L 13/58* (2013.01)

(58) Field of Classification Search

CPC ..... A47L 13/16; A47L 13/256; A47L 13/257; A47L 13/44; A47L 13/20; A47L 13/254; A47L 13/58–59

USPC ..... 15/228; D32/40

See application file for complete search history.

(56) References Cited

U.S. PATENT DOCUMENTS

| | | | |
|---|---|---|---|
| 395,960 | A | 1/1889 | Drew |
| 1,517,187 | A | 11/1924 | Bonsall |
| 1,673,473 | A | 6/1928 | Sands |
| 2,286,944 | A | 6/1942 | Altland |
| 2,671,239 | A | 3/1954 | Wisner |

(Continued)

FOREIGN PATENT DOCUMENTS

| | | | |
|---|---|---|---|
| AU | 2014215927 | A1 | 9/2014 |
| BE | 1009731 | A6 | 7/1997 |

(Continued)

OTHER PUBLICATIONS

International Search Report and Written Opinion for International Application No. PCT/US2020/63749 dated Mar. 11, 2021; pp. 8.

(Continued)

*Primary Examiner* — Laura C Guidotti

(74) *Attorney, Agent, or Firm* — McCarter & English, LLP; Dave S. Christensen

(57) ABSTRACT

A mop pad, a flat headed mop, and a surface cleaning system is provided. The mop pad comprising a cleaning layer configured to remove contaminants from a surface being cleaned. A backing layer is coupled to the cleaning layer, the backing layer having a fastener configured to couple the backing layer to a mop head. At least one insert member (Continued)

coupled between at least one of the backing layer and the cleaning layer, the at least one insert being arranged adjacent an end of the mop pad.

18 Claims, 8 Drawing Sheets

(56) References Cited

U.S. PATENT DOCUMENTS 2,740,146 A 4/1956 Vaughn
2,796,617 A 6/1957 Bradshaw
2,852,794 A 9/1958 Blum
2,966,689 A 1/1961 Antonucci, Jr.
D195,818 S 8/1963 Herman et al.
3,280,418 A 10/1966 Schonberger
3,341,876 A 9/1967 Campbell
D212,831 S 11/1968 Koch
D249,821 S 10/1978 Cooke
4,161,799 A 7/1979 Sorrells
4,344,201 A 8/1982 Trisolini
4,685,167 A * 8/1987 Murray ..... A47L 13/24 15/228
4,704,763 A 11/1987 Sacks et al.
D296,254 S 6/1988 Jaros et al.
D297,275 S 8/1988 Cook
4,799,283 A 1/1989 Haydon
4,852,210 A * 8/1989 Krajicek ..... A47L 13/20 15/228
4,912,804 A 4/1990 Pasbol
5,082,139 A 1/1992 Quam
5,094,559 A * 3/1992 Rivera ..... A47L 13/17 401/196
5,115,535 A 5/1992 Casademunt Ferre et al.
5,131,111 A 7/1992 Richardson et al.
5,191,166 A 3/1993 Smirlock et al.
D338,299 S 8/1993 Delmerico et al.
5,274,877 A 1/1994 Morad et al.
5,333,353 A 8/1994 Taylor
D358,238 S 5/1995 Barnett
5,414,892 A 5/1995 Clark, Jr.
5,419,015 A * 5/1995 Garcia ..... A47L 13/20 15/228
5,438,727 A 8/1995 Specht
5,440,778 A 8/1995 De Guzman
D362,941 S 10/1995 Delmerico et al.
5,548,865 A 8/1996 Pagani
D374,321 S 10/1996 Mandell et al.
5,774,929 A 7/1998 Jurgens et al.
D396,914 S 8/1998 Pepper et al.
5,836,039 A * 11/1998 Rimer ..... A47L 13/258 15/228
5,864,914 A 2/1999 Salmon
5,918,343 A 7/1999 Young
5,945,193 A 8/1999 Pollard et al.
D417,051 S 11/1999 Dickinson et al.
5,983,441 A 11/1999 Williams et al.
D426,361 S 6/2000 Young
D427,401 S 6/2000 Kunkler
6,115,877 A 9/2000 Morad et al.
6,115,878 A 9/2000 McLaughlin et al.
6,128,803 A 10/2000 Dickinson et al.
6,158,089 A 12/2000 Monahan et al.
6,260,226 B1 7/2001 Specht
6,279,195 B1 8/2001 Biggs
6,283,170 B1 9/2001 Robinson
6,354,666 B1 * 3/2002 Atkins ..... A46D 3/00 300/16
6,374,867 B1 4/2002 Maiuro
6,457,203 B1 10/2002 Williams et al.
6,460,230 B2 10/2002 Shimamura et al.
6,487,745 B2 12/2002 Specht
6,543,081 B1 4/2003 Cohen
D477,447 S 7/2003 Calaicone
6,588,045 B2 7/2003 Fernandez
6,640,348 B1 11/2003 Clune et al.
6,671,923 B2 1/2004 Gromnicki
D489,852 S 5/2004 Perelli
6,737,147 B2 5/2004 Kennedy et al.
D497,699 S 10/2004 Chi-Hsiang
6,810,554 B2 11/2004 McKay
D505,762 S 5/2005 Lalanne
6,886,703 B1 5/2005 Bonner
6,996,873 B2 2/2006 Salmon
D525,404 S 7/2006 Petner et al.
D527,506 S 8/2006 Camp, Jr. et al.
D528,729 S 9/2006 Van Landingham, Jr.
D530,870 S 10/2006 Lauer
D531,368 S 10/2006 Lauer
D531,772 S 11/2006 Lauer
D533,705 S 12/2006 Bertucci et al.
D533,977 S 12/2006 Bensussan et al.
D536,851 S 2/2007 Lauer
7,174,600 B2 2/2007 Kresse et al.
D542,494 S 5/2007 Lauer et al.
D542,992 S 5/2007 Lauer
D546,012 S 7/2007 Casteel et al.
D548,913 S 8/2007 Van Landingham, Jr.
7,254,863 B1 8/2007 Morad
D550,418 S 9/2007 Weaver et al.
7,293,317 B2 11/2007 Tsuchiya et al.
D563,068 S 2/2008 Jiang
D566,916 S 4/2008 Nobile
D571,069 S 6/2008 Harper
D578,263 S 10/2008 Pho
D585,612 S 1/2009 Soller
7,516,508 B2 4/2009 Stackpole, Jr. et al.
7,536,743 B2 5/2009 Goh et al.
D597,717 S 8/2009 Rosenzweig
7,607,191 B2 10/2009 Morris et al.
D607,165 S 12/2009 Libman et al.
D611,215 S 3/2010 Miller et al.
D616,168 S 5/2010 Libman et al.
D617,066 S 6/2010 Koenig
D625,480 S 10/2010 Raven
7,827,649 B2 11/2010 Horian
D638,186 S 5/2011 Yoon
D638,596 S 5/2011 Vasilakes
7,946,445 B2 5/2011 Tytar
D641,116 S 7/2011 Jones et al.
D643,982 S 8/2011 Franklin
D644,386 S 8/2011 Tawara
8,056,178 B2 11/2011 Bar-Noy et al.
8,099,824 B2 1/2012 Dingert et al.
D653,826 S 2/2012 Lee
D655,876 S 3/2012 Lee
D657,928 S 4/2012 Byrne
D658,344 S 4/2012 Babic
D658,836 S 5/2012 Ediger
8,220,103 B1 7/2012 Lewis
D673,748 S 1/2013 Snyder
D677,031 S 2/2013 Best
8,381,931 B1 2/2013 Ernest, III
8,393,047 B2 3/2013 Van Landingham, Jr. et al.
8,419,024 B1 4/2013 Arroyo-Ferrer
8,474,089 B2 7/2013 Goentzel
8,479,352 B2 7/2013 Rivadulla Oliva
8,544,141 B1 10/2013 Kyde et al.
8,567,616 B2 10/2013 Mishan et al.
8,584,300 B2 11/2013 Weis
8,652,263 B2 2/2014 Goentzel
D703,407 S 4/2014 Xiong
8,701,238 B1 4/2014 Morad et al.
8,771,428 B1 7/2014 Goentzel
D720,906 S 1/2015 Baldwin
8,990,998 B1 * 3/2015 McBride, Jr. ..... A47L 13/22 15/228
9,161,673 B2 10/2015 Tronconi et al.
9,216,751 B2 12/2015 Adams et al.
D747,053 S 1/2016 Baldwin
D756,581 S 5/2016 Libman
D759,329 S 6/2016 Colangelo
9,433,335 B2 6/2016 Nolan et al.
D766,528 S 9/2016 Choi

(56) References Cited

U.S. PATENT DOCUMENTS

| | | | | |
|---|---|---|---|---|
| 9,504,366 | B2 | 11/2016 | Kasper et al. | |
| D782,767 | S | 3/2017 | Kearney | |
| 9,713,412 | B2 * | 7/2017 | Maurer | A47L 13/20 |
| D793,639 | S | 8/2017 | Schuller | |
| D809,727 | S | 2/2018 | Bensussan et al. | |
| 9,932,056 | B2 | 4/2018 | Eisenhut et al. | |
| 9,943,207 | B1 | 4/2018 | Patterson | |
| 10,743,737 | B1 | 8/2020 | Parrott | |
| 10,858,139 | B2 | 12/2020 | Eason | |
| D915,703 | S | 4/2021 | Harrington et al. | |
| D923,896 | S | 6/2021 | Harrington et al. | |
| 11,064,842 | B2 | 7/2021 | McDonald | |
| D933,325 | S | 10/2021 | Harrington et al. | |
| D955,075 | S | 6/2022 | Harrington et al. | |
| D962,575 | S | 8/2022 | Harrington et al. | |
| 2002/0073502 | A1 | 6/2002 | Gromnicki | |
| 2002/0120997 | A1 | 9/2002 | Alt | |
| 2003/0019954 | A1 | 1/2003 | Clarke | |
| 2003/0121530 | A1 * | 7/2003 | Borgonjon | B32B 5/26 15/118 |
| 2004/0019998 | A1 | 2/2004 | Sander | |
| 2004/0074520 | A1 | 4/2004 | Truong et al. | |
| 2004/0128786 | A1 * | 7/2004 | Policicchio | A47L 13/20 15/228 |
| 2004/0139585 | A1 | 7/2004 | McVicker | |
| 2004/0231700 | A1 * | 11/2004 | Bell | A47L 13/26 15/118 |
| 2005/0022843 | A1 | 2/2005 | Policicchio | |
| 2005/0086760 | A1 * | 4/2005 | Young | A47L 13/58 15/260 |
| 2005/0086980 | A1 | 4/2005 | Young | |
| 2005/0100403 | A1 | 5/2005 | Kruepke | |
| 2005/0115098 | A1 * | 6/2005 | Rust | A47L 13/58 15/260 |
| 2005/0229352 | A1 | 10/2005 | LeCompte et al. | |
| 2006/0048330 | A1 | 3/2006 | Rust et al. | |
| 2006/0070202 | A1 | 4/2006 | Lauer et al. | |
| 2006/0151054 | A1 | 7/2006 | Deaton | |
| 2006/0213021 | A1 | 9/2006 | Ducharme | |
| 2006/0272115 | A1 | 12/2006 | Kacher et al. | |
| 2007/0026181 | A1 | 2/2007 | Roberts | |
| 2007/0061985 | A1 | 3/2007 | Fischer | |
| 2007/0074365 | A1 | 4/2007 | Erdman et al. | |
| 2007/0107155 | A1 | 5/2007 | Kacher et al. | |
| 2007/0134465 | A1 | 6/2007 | Vanbenschoten et al. | |
| 2007/0266518 | A1 | 11/2007 | Hoyle et al. | |
| 2007/0289084 | A1 | 12/2007 | Damrath et al. | |
| 2008/0006640 | A1 | 1/2008 | Natale | |
| 2008/0141477 | A1 | 6/2008 | Damrath et al. | |
| 2008/0155775 | A1 | 7/2008 | Damrath et al. | |
| 2009/0007351 | A1 | 1/2009 | Horian | |
| 2009/0035507 | A1 | 2/2009 | Kurtz, Jr. | |
| 2009/0035509 | A1 | 2/2009 | Kurtz, Jr. | |
| 2010/0050363 | A1 | 3/2010 | Young | |
| 2011/0010900 | A1 | 1/2011 | Gilardi | |
| 2011/0099745 | A1 | 5/2011 | Van Landingham, Jr. et al. | |
| 2011/0203613 | A1 | 8/2011 | Roberts | |
| 2012/0042462 | A1 * | 2/2012 | Milanese | A47L 13/20 15/322 |
| 2012/0096668 | A1 | 4/2012 | Treacy | |
| 2012/0110774 | A1 | 5/2012 | Matola | |
| 2012/0145189 | A1 * | 6/2012 | Knopow | F24V 30/00 134/6 |
| 2012/0151703 | A1 | 6/2012 | Chow | |
| 2013/0312211 | A1 | 11/2013 | Matola | |
| 2014/0215739 | A1 | 8/2014 | Lindner et al. | |
| 2014/0259496 | A1 | 9/2014 | Wahlquist | |
| 2014/0263105 | A1 | 9/2014 | Kontorovich et al. | |
| 2014/0289985 | A1 | 10/2014 | Hoying et al. | |
| 2015/0201821 | A1 | 7/2015 | McBride, Jr. et al. | |
| 2015/0305590 | A1 | 10/2015 | Rashid | |
| 2015/0351603 | A1 | 12/2015 | Katsnelson | |
| 2016/0068176 | A1 | 3/2016 | Adams et al. | |
| 2016/0113471 | A1 | 4/2016 | Zhu et al. | |
| 2016/0128540 | A1 | 5/2016 | Hoying et al. | |
| 2016/0309980 | A1 | 10/2016 | LeCompte et al. | |
| 2016/0316988 | A1 | 11/2016 | Balz et al. | |
| 2017/0027403 | A1 | 2/2017 | Zhu | |
| 2017/0049292 | A1 | 2/2017 | Harrington et al. | |
| 2017/0086637 | A1 | 3/2017 | Zhu et al. | |
| 2017/0231457 | A1 | 8/2017 | Cloud | |
| 2017/0369342 | A1 | 12/2017 | Hom et al. | |
| 2018/0035862 | A1 | 2/2018 | Polti et al. | |
| 2018/0055327 | A1 | 3/2018 | Li | |
| 2018/0079994 | A1 | 3/2018 | Parsons et al. | |
| 2018/0199788 | A1 | 7/2018 | Huang | |
| 2019/0365186 | A1 | 12/2019 | Buckley | |
| 2019/0365192 | A1 | 12/2019 | Harrington et al. | |
| 2019/0365193 | A1 | 12/2019 | Smith et al. | |

FOREIGN PATENT DOCUMENTS

| | | | |
|---|---|---|---|
| CA | 1306592 | C | 8/1992 |
| CA | 2993591 | A1 | 12/2017 |
| CN | 2081281 | U | 7/1991 |
| CN | 200987655 | Y | 12/2007 |
| CN | 201227258 | Y | 4/2009 |
| CN | 201227259 | Y | 4/2009 |
| CN | 201384477 | Y | 1/2010 |
| CN | 101843468 | A | 9/2010 |
| CN | 201675888 | U | 12/2010 |
| CN | 202211661 | U | 5/2012 |
| CN | 202313166 | U | 7/2012 |
| CN | 102711578 | A | 10/2012 |
| CN | 102846284 | A | 1/2013 |
| CN | 202821248 | U | 3/2013 |
| CN | 203029178 | U | 7/2013 |
| CN | 103445735 | A | 12/2013 |
| CN | 204146974 | U | 2/2015 |
| CN | 104853664 | A | 8/2015 |
| CN | 204744046 | U | 11/2015 |
| CN | 204889883 | U | 12/2015 |
| CN | 105286740 | A | 2/2016 |
| CN | 105640460 | A | 6/2016 |
| CN | 105769071 | A | 7/2016 |
| CN | 205391076 | U | 7/2016 |
| CN | 205493747 | U | 8/2016 |
| CN | 105996932 | A | 10/2016 |
| CN | 205625834 | U | 10/2016 |
| CN | 205697619 | U | 11/2016 |
| CN | 205729277 | U | 11/2016 |
| CN | 205831737 | U | 12/2016 |
| CN | 205866707 | U | 1/2017 |
| CN | 206080445 | U | 4/2017 |
| CN | 206080446 | U | 4/2017 |
| CN | 106725163 | A | 5/2017 |
| CN | 106725164 | A | 5/2017 |
| CN | 206151396 | U | 5/2017 |
| CN | 206183214 | U | 5/2017 |
| CN | 206381142 | U | 8/2017 |
| CN | 107115077 | A | 9/2017 |
| CN | 206548456 | U | 10/2017 |
| CN | 107456178 | A | 12/2017 |
| CN | 107456179 | A | 12/2017 |
| CN | 107456180 | A | 12/2017 |
| CN | 107456181 | A | 12/2017 |
| CN | 107456184 | A | 12/2017 |
| CN | 107456185 | A | 12/2017 |
| CN | 107495914 | A | 12/2017 |
| CN | 107518843 | A | 12/2017 |
| CN | 206761652 | U | 12/2017 |
| CN | 107684406 | A | 2/2018 |
| CN | 107684407 | A | 2/2018 |
| CN | 107692938 | A | 2/2018 |
| CN | 107811591 | A | 3/2018 |
| CN | 207152550 | U | 3/2018 |
| CN | 207186587 | U | 4/2018 |
| CN | 207202839 | U | 4/2018 |
| CN | 304639767 | | 5/2018 |
| DE | 382754 | C | 10/1923 |
| DE | 4318792 | A1 | 12/1994 |
| DE | 19635620 | A1 | 3/1998 |
| DE | 10065373 | A1 | 7/2002 |

(56) References Cited

FOREIGN PATENT DOCUMENTS

| | | | |
|---|---|---|---|
| DE | 102016118256 | B3 | 1/2018 |
| EP | 0991355 | A1 | 4/2000 |
| EP | 1219224 | A1 | 7/2002 |
| EP | 1219226 | A1 | 7/2002 |
| EP | 1651089 | A1 | 5/2006 |
| EP | 2033565 | A2 | 3/2009 |
| EP | 2769660 | A1 | 8/2014 |
| EP | 2848178 | A2 | 3/2015 |
| FR | 3058627 | A1 | 5/2018 |
| GB | 379946 | A | 9/1932 |
| GB | 396469 | A | 8/1933 |
| GB | 932579 | A | 7/1963 |
| GB | 1168635 | A | 10/1969 |
| GB | 1277932 | A | 6/1972 |
| GB | 2426431 | A | 11/2006 |
| JP | H10-304998 | A | 11/1998 |
| JP | 2014-030815 | A | 2/2014 |
| KR | 20-0485755 | | 2/2018 |
| KR | 20180025263 | A | 3/2018 |
| WO | 1992/10968 | A1 | 7/1992 |
| WO | 2000001328 | A1 | 1/2000 |
| WO | 2002/000089 | A1 | 1/2002 |
| WO | 2004/080265 | A2 | 9/2004 |
| WO | 2005/013794 | A1 | 2/2005 |
| WO | 2006/027383 | A1 | 3/2006 |
| WO | 2006074687 | A1 | 7/2006 |
| WO | 2007046211 | A1 | 4/2007 |
| WO | 2015/090356 | A1 | 6/2015 |
| WO | 2016/116067 | A1 | 7/2016 |
| WO | 2017/193609 | A1 | 11/2017 |
| WO | 2017/206511 | A1 | 12/2017 |
| WO | 2018/024160 | A1 | 2/2018 |
| WO | 2018/040920 | A1 | 3/2018 |

OTHER PUBLICATIONS ecsupplies.com Unger® OmniClean Dual Bucket Kit—Black/Blue, 2023. <https://www.ecsupplies.com/p/UNG-CLBK1/Unger-OmniClean-Dual-Bucket-Kit-Black-Blue/>.

webstaurantstore.com Rubbermaid FGQ050000000 Blue Microfiber Floor Finishing System, 2023. <https://www.webstaurantstore.com/rubbermaid-fgq050000000-blue-microfiber-floor-finishing-system/690FGQ050000.html>.

European Office Action for Application No. 19810211.3, dated Mar. 14, 2022, 6 pages.

European Office Action for Application No. 19810953.0, dated Mar. 11, 2022, 8 pages.

European Office Action for Application No. 19810956.3, dated Feb. 10, 2022, 6 pages.

European Office Action for Application No. 19811600.6, dated Mar. 16, 2022, 6 pages.

International Search Report and Written Opinion for Application No. PCT/US2019/034282, dated Aug. 7, 2019, 9 pages.

Libman 4005 10" X 5" Freedom Dust Mop. Retrieved online at: https://www.overstock.com/Home-Garden/ Libman-4005-10-X-5-Freedom-Dust-Mop/12499953/customer-reviews.html. 4 pages, (2020).

Unger CLBK1 Dual Bucket Omniclean Kit. Retrieved online at: https://www.amazon.com/Unger-CLBK1-Dual-Bucket- Omniclean/dp/B08PMDRDJ5/ref=sr_1_4?dchild=1&keywords=omniclean&qid=1609341253&sr=8-4. 4 pages, (2020).

Unger, OmniClean. Retrieved online at: https://USA.ungerglobal.com/product-category/unger-omniclean/. 4 pages, (2020).

European Office Action for Application No. 20899582.9, dated Aug. 24, 2023, 7 pages.

* cited by examiner

FLOOR CLEANING SYSTEM, FLAT HEADED MOP AND MOP PAD

CROSS REFERENCE TO RELATED APPLICATIONS

This application claims the benefit of U.S. Provisional Application Ser. No. 62/946,614, filed Dec. 11, 2019, the entire disclosure of which is incorporated herein by reference.

BACKGROUND

The subject matter disclosed herein relates to a system for cleaning a floor, and in particular to a system having a mop pad that resists lifting, pealing or curling.

Mops have been traditionally used to clean floors. Mops come in different styles, such as a string, strip, foam or flat mop for example. A flat mop has a generally planar end member with a flat microfiber pad coupled to one side. Further, one property of the microfiber pad is that it releases dirt when placed in a fluid (e.g. fluid). The microfiber pad is then wrung-out, such as by pressing the mop head against a plate, a blade, or a roller. It should be appreciated that it is desirable for the mop pad to remain on the mop when it is being wrung-out. As a result there is a balance that needs to be achieved in conventional wringers between the amount of force applied to extract fluid and keeping the mop pad attached.

Accordingly, while existing floor cleaning systems, mops and mop pads are suitable for their intended purposes the need for improvement remains, particularly in providing a mop pad having the features described herein.

BRIEF DESCRIPTION

According to one aspect of the disclosure, a mop pad is provided. The mop pad comprising a cleaning layer configured to remove contaminants from a surface being cleaned. A backing layer is coupled to the cleaning layer, the backing layer having a fastener configured to couple the backing layer to a mop head. At least one insert member coupled between at least one of the backing layer and the cleaning layer, the at least one insert being arranged adjacent an end of the mop pad.

In addition to one or more of the features described herein, or as an alternative, further embodiments of the mop pad may include the at least one insert member having a first insert member and a second insert member, the first insert member being arranged at a first end of the mop pad, the second insert member being arranged at a second opposing end of the mop pad. In addition to one or more of the features described herein, or as an alternative, further embodiments of the mop pad may include the at least one insert member having a width that is smaller than a width of the backing layer. In addition to one or more of the features described herein, or as an alternative, further embodiments of the mop pad may include the at least one insert member width is about 10%-35% of the backing layer.

In addition to one or more of the features described herein, or as an alternative, further embodiments of the mop pad may include the at least one insert member width being about 50 millimeters. In addition to one or more of the features described herein, or as an alternative, further embodiments of the mop pad may include the cleaning layer being a microfiber layer. In addition to one or more of the features described herein, or as an alternative, further embodiments of the mop pad may include the cleaning layer being made of cotton, polyester, textiles, foam, sponge, or a combination of the foregoing.

According to one aspect of the disclosure, a flat headed mop is provided. The flat headed mop comprising a pole and a mop head pivotally coupled to an end of the pole. A mop pad is removably coupled to the mop head. The mop pad comprises a cleaning layer configured to remove contaminants from a surface being cleaned. A backing layer is coupled to the cleaning layer, the backing layer having a fastener configured to couple the backing layer to a mop head. At least one insert member is coupled between at least one of the backing layer and the cleaning layer, the at least one insert being arranged adjacent an end of the mop pad.

In addition to one or more of the features described herein, or as an alternative, further embodiments of the flat headed mop may include the mop pad being coupled to the mop head by a hook and loop fastener. In addition to one or more of the features described herein, or as an alternative, further embodiments of the flat headed mop may include a portion of the hook and loop fastener being arranged on the backing layer. In addition to one or more of the features described herein, or as an alternative, further embodiments of the flat headed mop may include the at least one insert member having a first insert member and a second insert member, the first insert member being arranged at a first end of the mop pad, the second insert member being arranged at a second opposing end of the mop pad.

In addition to one or more of the features described herein, or as an alternative, further embodiments of the flat headed mop may include the at least one insert member having a width that is smaller than a width of the backing layer. In addition to one or more of the features described herein, or as an alternative, further embodiments of the flat headed mop may include the at least one insert member width is about 10%-35% of the backing layer. In addition to one or more of the features described herein, or as an alternative, further embodiments of the flat headed mop may include the at least one insert member width is about 50 millimeters.

In addition to one or more of the features described herein, or as an alternative, further embodiments of the flat headed mop may include the cleaning layer is a microfiber layer. In addition to one or more of the features described herein, or as an alternative, further embodiments of the flat headed mop may include the cleaning layer is made of cotton, polyester, textiles, foam, sponge, or a combination of the foregoing.

According to one aspect of the disclosure, a surface cleaning system is provided. The surface cleaning system comprising a bucket assembly having a wringing assembly. A mop having a pole and a mop head is pivotally coupled to an end of the pole, the mop further having a mop pad removably coupled to the mop head. The mop pad comprises a cleaning layer configured to remove contaminants from a surface being cleaned. A backing layer is coupled to the cleaning layer, the backing layer having a fastener configured to couple the backing layer to a mop head. At least one insert member is coupled between at least one of the backing layer and the cleaning layer, the at least one insert being arranged adjacent an end of the mop pad.

In addition to one or more of the features described herein, or as an alternative, further embodiments of the surface cleaning system may include the at least one insert member having a first insert member and a second insert member, the first insert member being arranged at a first end of the mop pad, the second insert member being arranged at a second opposing end of the mop pad. In addition to one or more of the features described herein, or as an alternative, further embodiments of the surface cleaning system may include the at least one insert member having a width that is smaller than a width of the backing layer. In addition to one or more of the features described herein, or as an alternative, further embodiments of the surface cleaning system may include the at least one insert member width having about 10%-35% of the backing layer.

Technical effects of embodiments of the present disclosure include a mop pad for a floor cleaning system that is supported to reduce or eliminate curl or lifting of the mop pad from the mop head during wringing operations.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments disclosed herein provide for a cleaning system, a mop and a mop pad that resists lifting, pealing or curling of the mop pad during a wringing operation.

Figure 1:
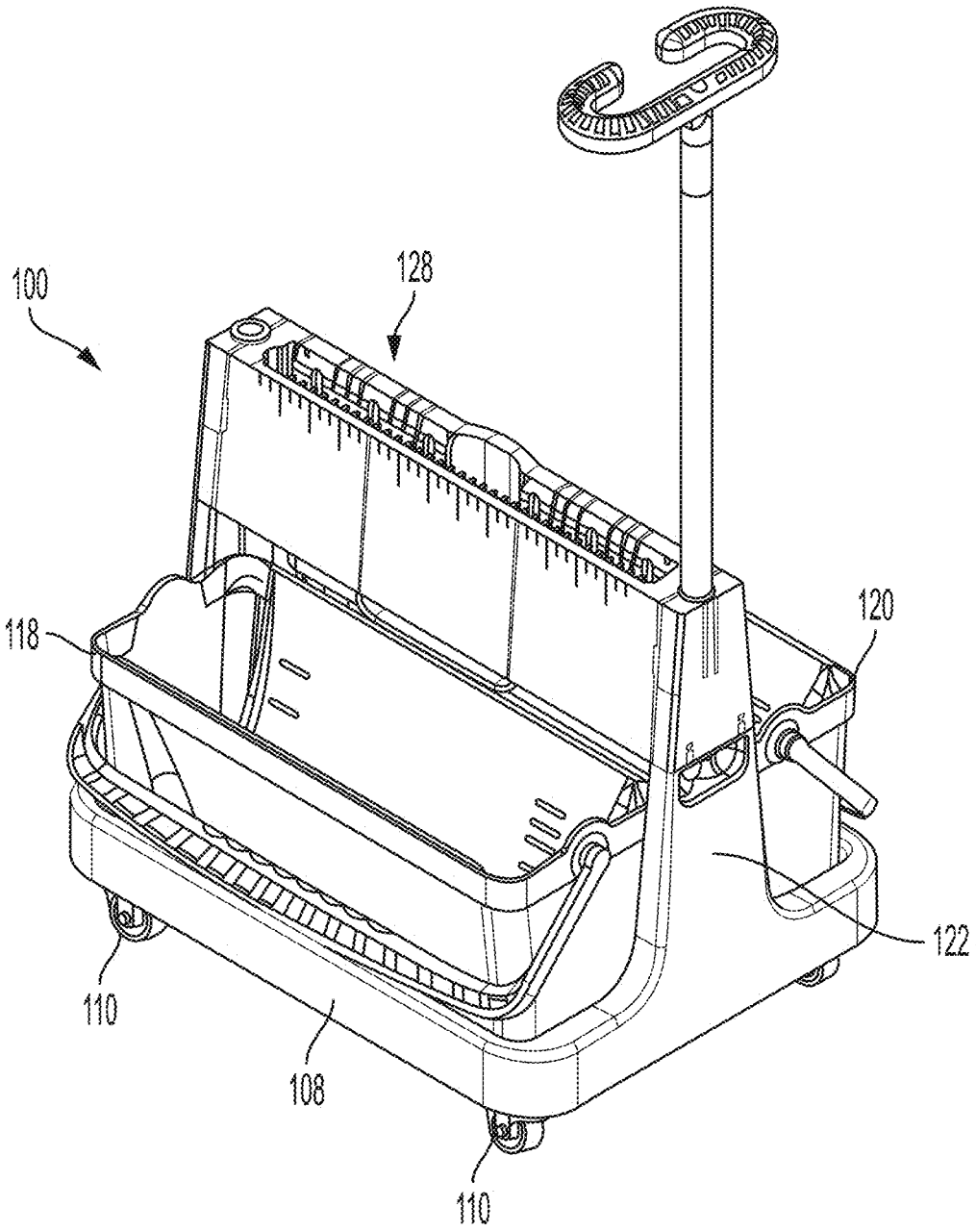
FIG. 1 is a perspective view of a two-compartment bucket assembly for a floor cleaning system in accordance with an embodiment.
Figure 2A:
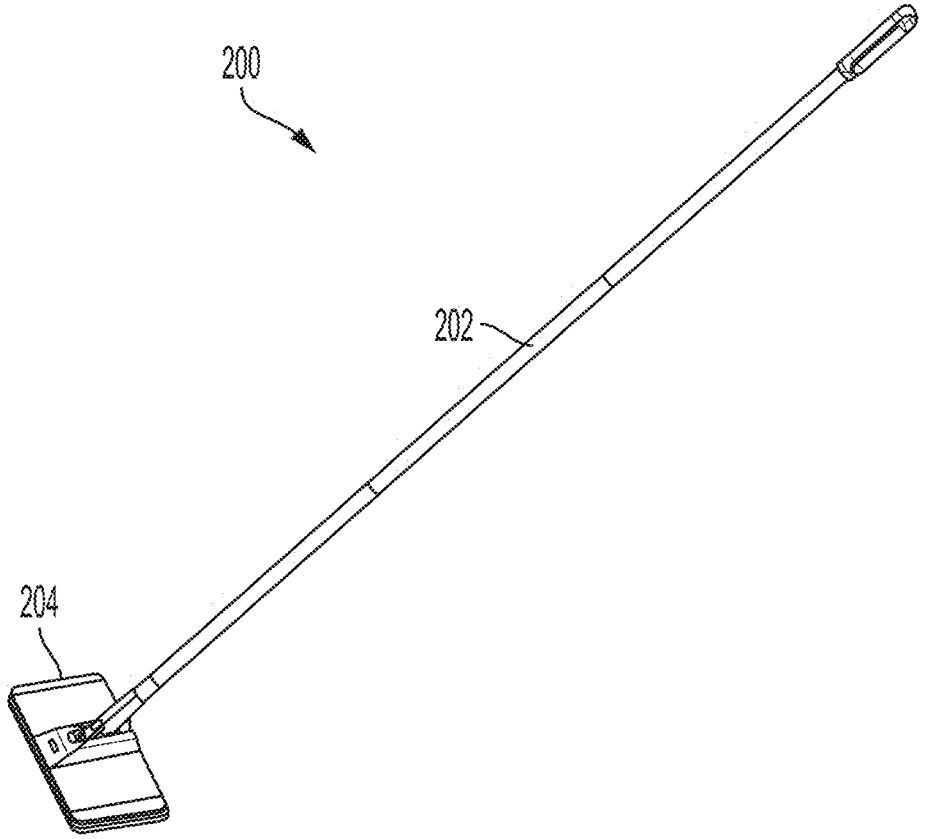
FIG. 2A is a perspective view of a mop for use with the bucket assembly of FIG. 1 in accordance with an embodiment.

Referring now to FIG. 1, an embodiment of a bucket assembly 100 is shown for a floor cleaning system. The bucket assembly 100 is used with a flat headed mop 200, such as that shown in FIGS. 2A-2C for example, having a microfiber mop pad 300 disposed thereon. The mop 200 has a head 204 positioning assembly that allows the head 204 of the mop 200 to rotate between a vertical and an operating position. The mop 200 may be connected to the head 204 by a hinge assembly such as that described in commonly owned U.S. application Ser. No. 16/423,804 entitled "Flat Headed Mop" the contents of which is incorporated herein by reference. The mop 200 may further be that described in commonly owned U.S. patent application Ser. No. 29/678,328 entitled "Flat Headed Mop", the contents of which is incorporated by reference herein. The mop 200 will further include a mop pad 300 that is removably coupled to the head 204. In an embodiment, the mop pad 300 and the head 204 are coupled together by a hook and loop type fastener. When in the operating position, the bottom surface of the head 204 is generally parallel with the floor or surface that is being cleaned with the pole 202 extending upward therefrom.

Figure 2B:
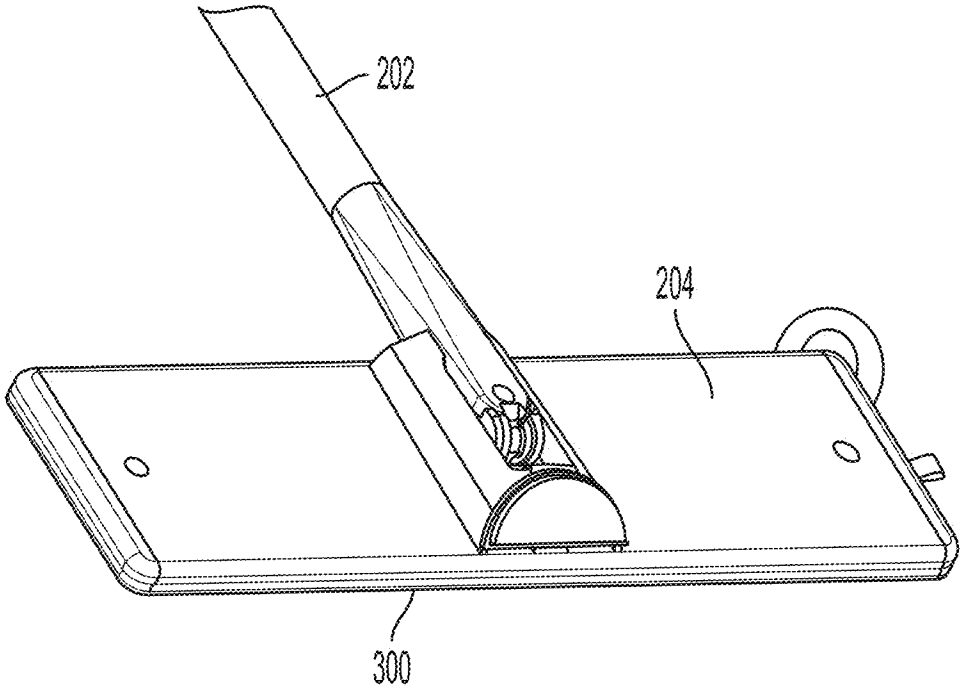
FIG. 2B is an enlarged view of a mop head end of the mop of FIG. 2A.
Figure 2C:
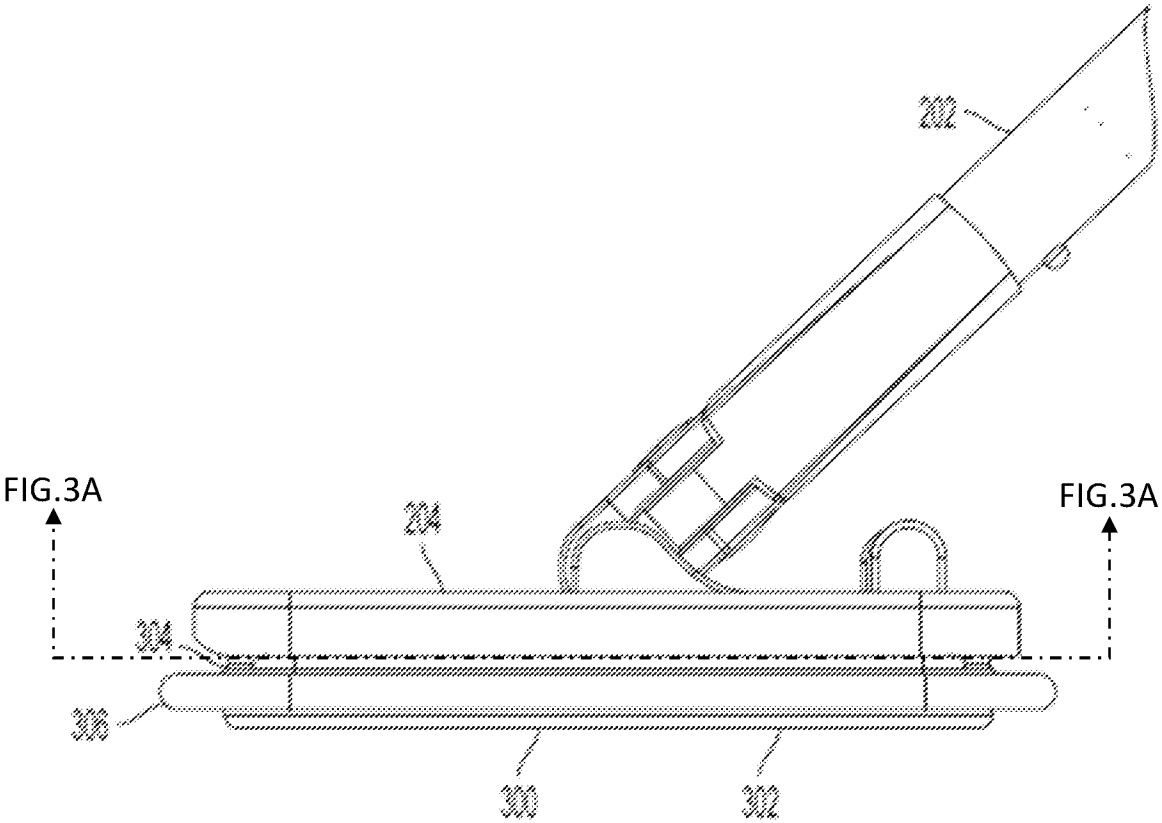
FIG. 2C is a side view of the mop head of FIG. 2B.
Figure 3A:
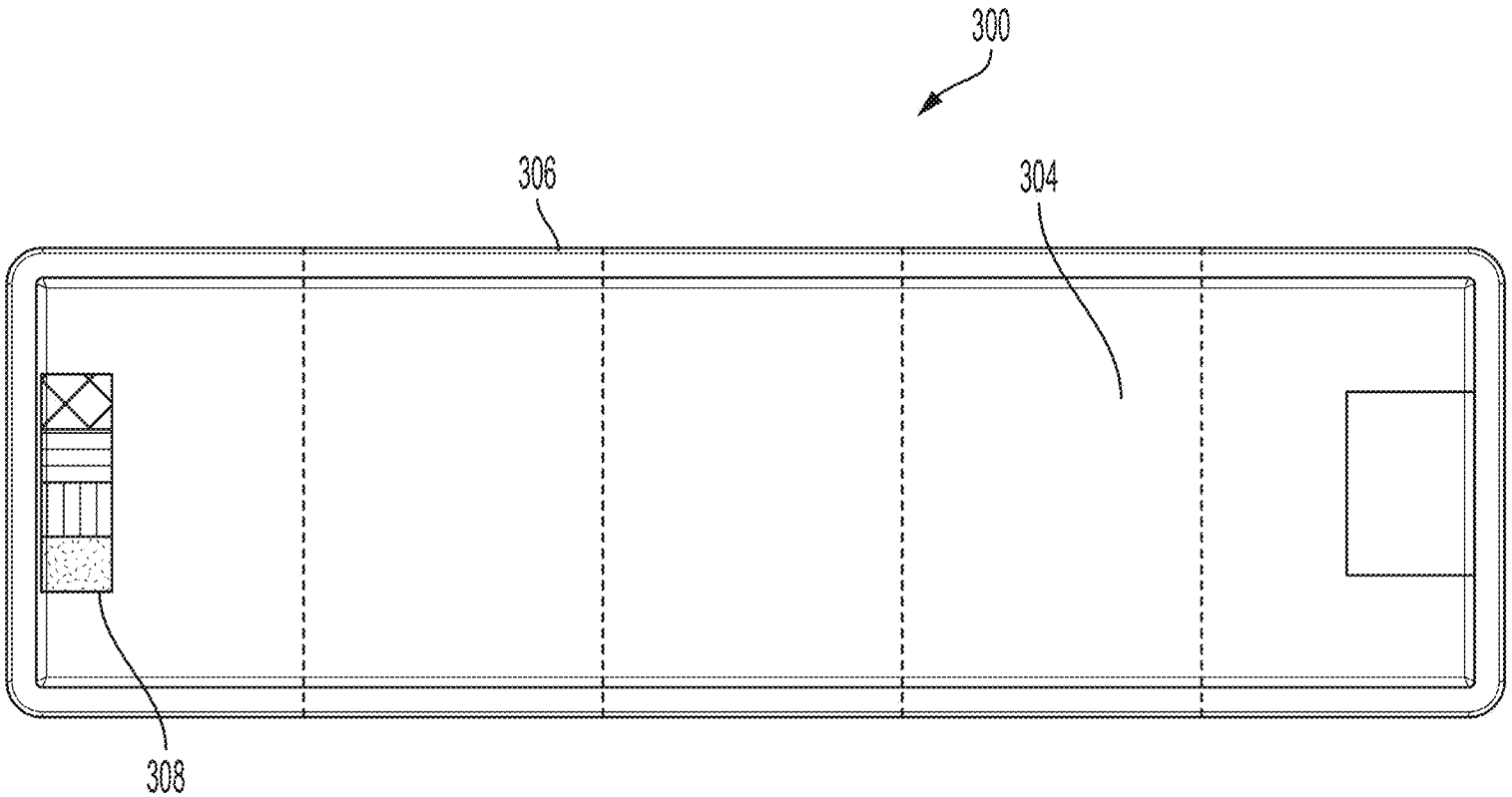
FIG. 3A is a top view of a mop pad for use with the mop head of FIG. 2A in accordance with an embodiment.
Figure 3B:
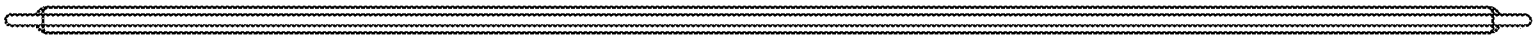
FIG. 3B is a side view of the mop pad of FIG. 3A.
Figure 3C:
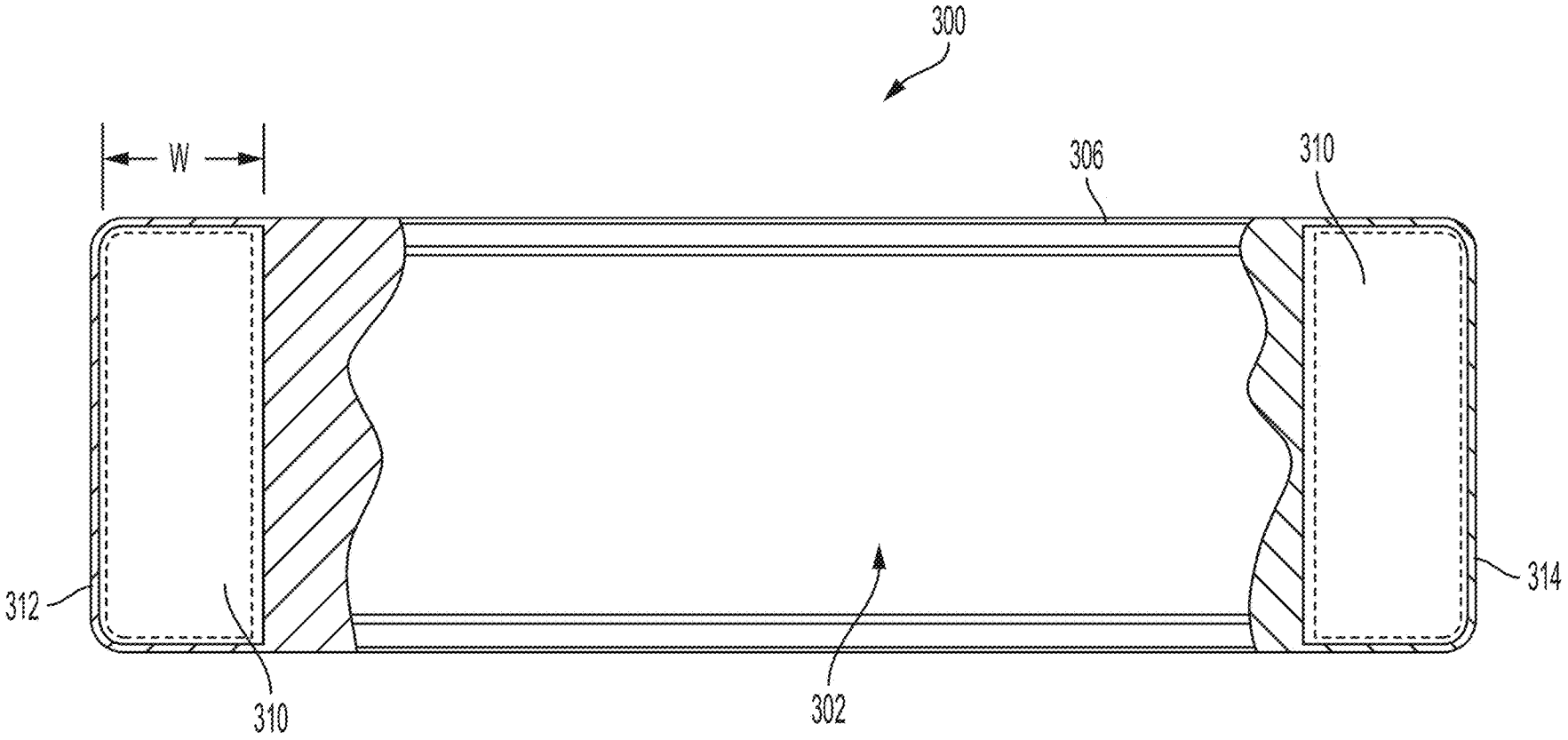
FIG. 3C is a top schematic illustration, partially in section, of the mop pad of FIG. 3A along the line 3A-3A of FIG. 2C.
Figure 3D:
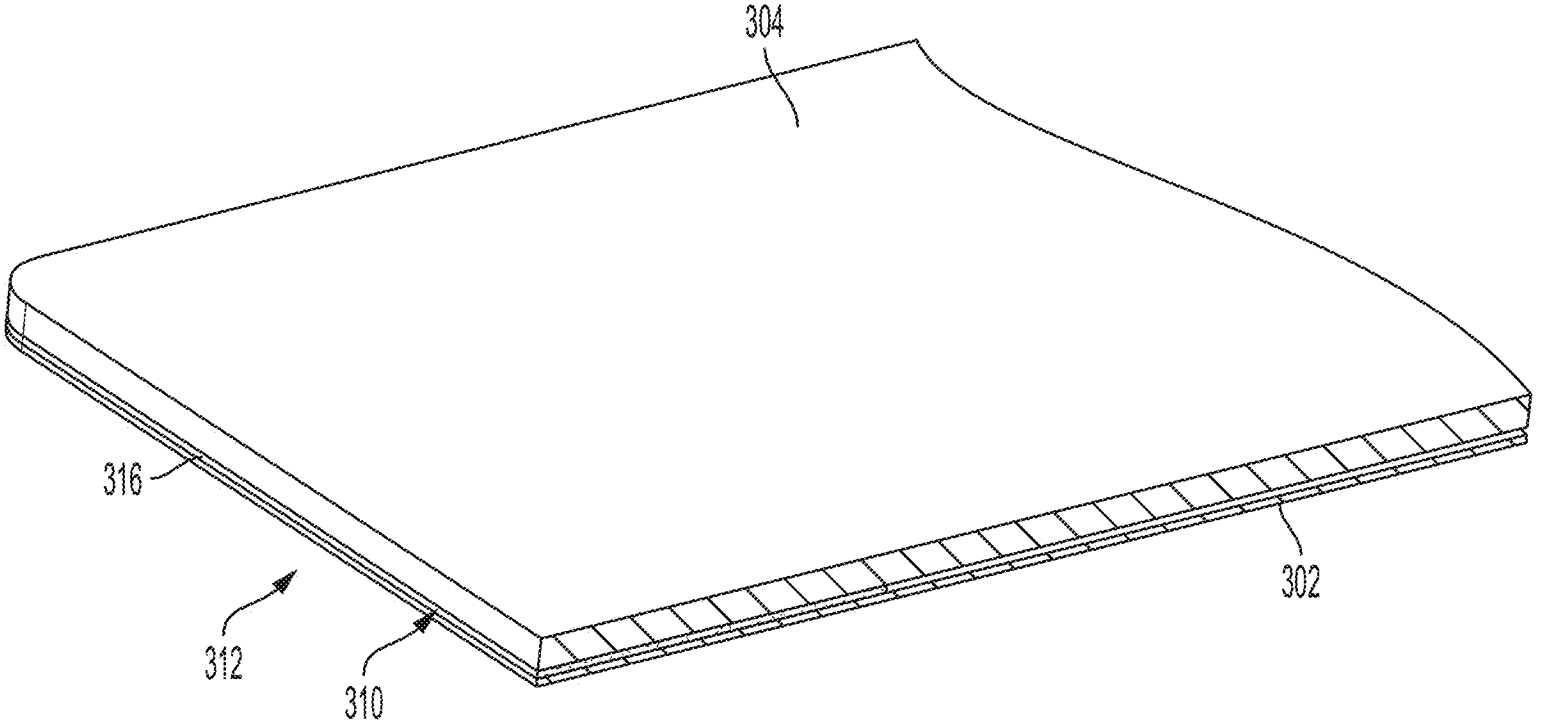
FIG. 3D is a partial perspective view of the mop pad of FIG. 3A.

As used herein, the term "vertical position" is where the mop head 204 is rotated to the position shown in FIG. 2B where the planar bottom surface head member or the mop pad 300 is generally or substantially parallel to the centerline of the mop pole 202. As used herein, the term "operating position" is where the mop head 204 is rotated to the position shown in FIG. 2A where the planar bottom surface the mop head 204 is generally on an angle relative (e.g. greater than zero) to the centerline of the mop pole

202. In other words, in the operating position the pole extends on an angle so that the operator may hold the pole and move the mop head when in a standing position. It should be appreciated that while embodiments described herein may illustrate the mop head 204 rotated to the operating or horizontal position, this for exemplary purposes and the claims should not be so limited.

In an embodiment, the bucket assembly 100 includes a trolley 108 having a plurality of wheels 110. It should be appreciated that the wheels 110 allow the bucket assembly 100 to be easily moved across the floor. In the embodiment of FIG. 1, the trolley 108 includes a pair of recesses disposed on opposite sides of a center wall. The recesses are further defined by sidewalls. The recesses are sized to removably receive compartments 118, 120. The trolley 108 further includes a pair of upstanding posts or end walls 122 on either end of the center wall. The end walls 122 are configured couple with a drain tray that is positioned adjacent to and vertically above the center wall. The drain tray receives extracted fluid from a wringing assembly 128 and defines a flow path into the first compartment 118, sometimes referred to as the "dirty fluid" compartment. As used herein, the fluid may be water, a chemical cleaning solution or a combination of the foregoing. The compartments 118, 120 may both include a fluid that is comprised of water, a cleaning solution or a combination of the foregoing.

In an embodiment, the trolley 108 may be the same as that described in commonly owned U.S. patent application Ser. No. 16/423,817 entitled "Floor Cleaning System", or U.S. patent application Ser. No. 16/423,792 entitled "Floor Cleaning System", the contents of both of which are incorporated by reference herein in their entirety.

Referring now to FIGS. 3A-3D an embodiment is shown of a mop pad 300. It should be appreciated that when the mop head 204 and the mop pad 300 are inserted into the wringing assembly 128 forces are applied to the mop pad 300 that would tend to peel, lift, or curl the mop pad 300 away from the mop head 204 as they are inserted and withdrawn from the wringing assembly 128. In an embodiment, the mop pad 300 is formed from multiple layers with a reinforcing intermediate layer that reduces the risk of the mop pad 300 pealing, curling, or lifting from the mop head. This has the technical effect of reducing or eliminating the risk of the mop pad 300 becoming jammed or stuck within the wringing assembly 128.

In an embodiment, the mop pad 300 includes a cleaning or microfiber layer 302 and an opposing backing layer 304. The microfiber layer 302 is arranged opposite the mop head 204 when the mop pad 300 is installed on the mop head 204. In the exemplary embodiment, the backing layer 304 includes one portion of a hook and loop fastener. The second portion of the hook and loop fastener is on the mop head 204 and allows the mop pad 300 to be secured to the mop head 204.

The microfiber layer 302 may be made from a polyester, polyamide, polypropylene or a combination of the foregoing. In some embodiments, the mop pad may be made from, but is not limited to a pad made from: cotton, sponge, foam material for example. The backing layer 304 may be made from a nylon, a polyester, or a combination of the foregoing. The microfiber layer 302 is coupled to the backing layer 304 by a by an edge binding 306. In an embodiment, the edge binding may be made from 100% polyester material.

In an embodiment, one or more coding tag 308 may be coupled to either the edge binding 306 or the backing layer 304. The layers 302, 304 and edge binding 306 may be coupled or sewn together with thread.

In the illustrated embodiment, one or more insert members 310 are arranged between the microfiber layer 302 and the backing layer 304. In an embodiment, there is only one insert member. In another embodiment, there is a first insert member and a second insert member. The insert members 310 are positioned adjacent each end 312, 314 of the mop pad 300. The insert members 310 may have a short width "W" relative to the overall width of the mop pad 300. In an embodiment, the width W is about 10-35% of the width of the mop pad 300. In an embodiment, the width is 50 millimeters. The insert member 310 may be coupled to the backing layer 304, the microfiber layer 302, the edge binding 306, or a combination of the foregoing. In an embodiment, the insert member 310 is sewn to the layers 302, 304 or edge binding 306. It should be appreciated that in other embodiments, the insert member 310 may be coupled using other means, such as but not limited to adhesive bonding or ultrasonic welding for example. In an embodiment, the insert member 310 has radiused corners to conform with the shape of the edge binding 306. In an embodiment, an end 316 of the insert member 310 is aligned with an end of at least one of the microfiber layer 302 or the backing layer 304. The insert member 310 may be made from a plastic material, such as high density polyethylene. In an embodiment, the insert member 310 has a thickness of 0.25-2 millimeters.

It should be appreciated that when the mop pad 300 is placed on the mop head 204 and used for cleaning a surface, the microfiber layer 302 will eventually become dirty with contaminants from the surface. In an embodiment, the operator places the mop head in the fluid in compartment 120 and then removes excess fluid by moving the mop head 204 through the wringing assembly 128. The insert members 310 act to stiffen the ends of the mop pad 300 and resist the lifting or curling forces that are imparted on the mop pad 300 and mop head 204 by the wringing assembly 128.

It should be appreciated that while embodiments herein refer to the cleaning layer and being made from a microfiber, this is for example purposes and the claims should not be so limited. In other embodiments, the microfiber layer may be made from a foam, sponge, woven material, unwoven material, cotton, polyester, textiles, or a combination of the foregoing.

The term "about" is intended to include the degree of error associated with measurement of the particular quantity based upon the equipment available at the time of filing the application.

It should also be noted that the terms "first", "second", "third", "upper", "lower", and the like may be used herein to modify various elements. These modifiers do not imply a spatial, sequential, or hierarchical order to the modified elements unless specifically stated.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A mop pad comprising:

a cleaning layer configured to remove contaminants from a surface being cleaned, the cleaning layer having a width and a length, the length being longer than the width;

a backing layer coupled to the cleaning layer, the backing layer having a hook and loop fastener configured to couple the backing layer to a mop head; and at least one insert member coupled between at least one of the backing layer and the cleaning layer, the at least one insert member being arranged transversely to the width of the cleaning layer and at an end of the cleaning layer, the at least one insert member having a width in the length direction of the cleaning layer that is 10%-35% of the length of the cleaning layer and configured to resist curling or lifting of the cleaning layer during operation when inserted into a wringing assembly.

2. The mop pad of claim 1, wherein the at least one insert member includes a first insert member and a second insert member, the first insert member being arranged transversely to the width of the cleaning layer and at a first end of the mop pad, the second insert member being arranged transversely to the width of the cleaning layer and at a second opposing end of the mop pad.

3. The mop pad of claim 1, wherein the width of the at least one insert member is about 50 millimeters.

4. The mop pad of claim 1, wherein the cleaning layer is a microfiber layer.

5. The mop pad of claim 1, wherein the cleaning layer is made of cotton, polyester, textiles, foam, sponge, or a combination of the foregoing.

6. The mop pad of claim 1, wherein the mod pad further comprises an edge binding configured to secure the cleaning layer and the backing layer together.

7. The mop pad of claim 6, wherein edge binding is configured to secure the at least one insert member between the backing layer and the cleaning layer.

8. A flat headed mop comprising:

a pole;

a mop head pivotally coupled to an end of the pole; and a mop pad removably coupled to the mop head by a hook and loop fastener, the mop pad comprising:

a cleaning layer configured to remove contaminants from a surface being cleaned, the cleaning layer having a width and a length, the length being longer than the width, a backing layer coupled to the cleaning layer, the backing layer having a portion of the hook and loop fastener configured to couple the backing layer to the mop head, and at least one insert member coupled between the backing layer and the cleaning layer, the at least one insert member being arranged transversely to the width of the cleaning layer and at an end of the cleaning layer, the at least one insert member having a width in the length direction of the cleaning layer that is 10%-35% of the length of the cleaning layer and configured to resist curling or lifting of the cleaning layer during operation when inserted into a wringing assembly.

9. The flat headed mop of claim 8, wherein the at least one insert member includes a first insert member and a second insert member, the first insert member being arranged transversely to the width of the cleaning layer and at a first end of the mop pad, the second insert member being arranged transversely to the width of the cleaning layer and at a second opposing end of the mop pad.

10. The flat headed mop of claim 8, wherein the width of the at least one insert member is about 50 millimeters.

11. The flat headed mop of claim 8, wherein the cleaning layer is a microfiber layer.

12. The flat headed mop claim 8, wherein the cleaning layer is made of cotton, polyester, textiles, foam, sponge, or a combination of the foregoing.

13. The flat headed mop of claim 8, wherein the mod pad further comprises an edge binding configured to secure the cleaning layer and the backing layer together.

14. The flat headed mop of claim 13, wherein edge binding is configured to secure the at least one insert member between the backing layer and the cleaning layer.

15. A surface cleaning system comprising:

a bucket assembly having a wringing assembly;

a mop having a pole and a mop head pivotally coupled to an end of the pole, the mop further having a mop pad removably coupled to the mop head by a hook and loop fastener, the mop pad comprising:

a cleaning layer configured to remove contaminants from a surface being cleaned, the cleaning layer having a width and a length, the length being longer than the width;

a backing layer coupled to the cleaning layer, the backing layer having a portion of the hook and loop fastener configured to couple the backing layer to the mop head; and at least one insert member coupled between the backing layer and the cleaning layer, the at least one insert member being arranged transversely to the width of the cleaning layer and at an end of the cleaning layer, the at least one insert member having a width in the length direction of the cleaning layer that is 10%-35% of the length of the cleaning layer and configured to resist curling or lifting of the cleaning layer during operation when inserted into the wringing assembly.

16. The surface cleaning system of claim 15, wherein the at least one insert member includes a first insert member and a second insert member, the first insert member being arranged transversely to the width of the cleaning layer and at a first end of the mop pad, the second insert member being arranged transversely to the width of the cleaning layer and at a second opposing end of the mop pad.

17. The surface cleaning system of claim 15, wherein the mod pad further comprises an edge binding configured to secure the cleaning layer and the backing layer together.

18. The surface cleaning system of claim 17, wherein edge binding is configured to secure the at least one insert member between the backing layer and the cleaning layer.

* * * * *